US010975895B2

(12) United States Patent
Tsutsui et al.

(10) Patent No.: US 10,975,895 B2
(45) Date of Patent: Apr. 13, 2021

(54) PISTON STRUCTURE BODY AND LIFTING DEVICE OF WATERCRAFT PROPULSION APPARATUS

(71) Applicant: Showa Corporation, Gyoda (JP)

(72) Inventors: Hayato Tsutsui, Fukuroi (JP); Nobuaki Tanaka, Fukuroi (JP)

(73) Assignee: Showa Corporation, Gyoda (JP)

( * ) Notice: Subject to any disclaimer, the term of this patent is extended or adjusted under 35 U.S.C. 154(b) by 0 days.

(21) Appl. No.: 16/570,598

(22) Filed: Sep. 13, 2019

(65) Prior Publication Data

US 2020/0283111 A1 Sep. 10, 2020

(30) Foreign Application Priority Data

Mar. 6, 2019 (JP) ..... JP2019-040917

(51) Int. Cl.
*F15B 15/14* (2006.01)

(52) U.S. Cl.
CPC ..... *F15B 15/1447* (2013.01); *F15B 15/1409* (2013.01)

(58) Field of Classification Search
CPC ... F15B 15/1409; F15B 15/1447; B63H 20/10
See application file for complete search history.

(56) References Cited

U.S. PATENT DOCUMENTS

| | | | | |
|---|---|---|---|---|
| 3,722,455 | A | 3/1973 | Carpenter | |
| 3,898,915 | A * | 8/1975 | Neuman | F15B 15/1433 91/395 |
| 5,032,094 | A | 7/1991 | Katogi | |
| 9,944,375 | B1 * | 4/2018 | Martin | F02B 61/045 |

FOREIGN PATENT DOCUMENTS

| | | |
|---|---|---|
| JP | 57-110806 A | 7/1982 |
| JP | 58-028159 B2 | 6/1983 |
| JP | 02-099494 A | 4/1990 |

OTHER PUBLICATIONS

Japanese Office Action dated Jan. 7, 2020 for the corresponding Japanese Patent Application No. 2019-040917.
Japanese Office Action dated Jun. 30, 2020 for the corresponding Japanese Patent Application No. 2019-040917.

* cited by examiner

*Primary Examiner* — F Daniel Lopez
(74) *Attorney, Agent, or Firm* — Leason Ellis LLP

(57) ABSTRACT

A piston structure body includes: a piston that includes a through hole, an inner circumferential portion, and an outer circumferential portion, the through hole being a hole that is formed to penetrate the piston axially through a center of a first face that is an end face on one end side in an axial direction, the inner circumferential portion defining the through hole and connected to the first face, the outer circumferential portion disposed to surround the inner circumferential portion and connected to the first face; and a piston rod that is inserted through the through hole. A first end face that is an end face of the inner circumferential portion on a back face side of the first face is positioned more closely to the first face than a second end face that is an end face of the outer circumferential portion on the back face side.

5 Claims, 8 Drawing Sheets

PISTON STRUCTURE BODY AND LIFTING DEVICE OF WATERCRAFT PROPULSION APPARATUS

CROSS-REFERENCE TO RELATED APPLICATIONS

This application is based upon and claims the benefit of priority to Japanese patent application No. 2019-040917, filed on Mar. 6, 2019, the entire contents of which are incorporated herein by reference.

TECHNICAL FIELD

The present invention relates to a piston structure body inside a cylinder device, and a lifting device of a watercraft propulsion apparatus using the piston structure body.

BACKGROUND ART

In the background art, cylinder devices are used in various fields. For example, such a cylinder device has been used as a tilt cylinder mainly serving for lifting an outboard motor up above water or lifting the outboard motor down below the water, or as a trim cylinder mainly serving for changing an angle of the outboard motor below the water (for example, see PTL 1 and PTL 2).

PTL 1: JP-B-58-028159

PTL 2: JP-A-2-99494

SUMMARY OF INVENTION

However, as to the cylinder device, it is preferable to increase a stroke length of a piston rod inside the cylinder device.

An object of the present invention is to realize a piston structure body etc. in which a stroke length of a piston rod can be increased.

According to an aspect of the invention, there is provided a piston structure body comprising: a piston that includes a through hole, an inner circumferential portion, and an outer circumferential portion, the through hole being a hole that is formed to penetrate the piston axially through a center of a first face (first surface) that is provided on one end side in an axial direction, the inner circumferential portion defining the through hole and connected to the first face, the outer circumferential portion disposed to surround the inner circumferential portion and connected to the first face; and a piston rod that is inserted through the through hole, wherein a first end face that is an end face of the inner circumferential portion on a back face side of the first face is positioned more closely to the first face than a second end face that is an end face of the outer circumferential portion on the back face side.

According to an aspect of the present invention, it is possible to increase a stroke length of the piston rod.

DESCRIPTION OF EMBODIMENTS

Embodiment 1

A cylinder device 1 according to Embodiment 1 will be described with reference to FIGS. 1 to 3 and FIGS. 4A and 4B.

Figure 1:
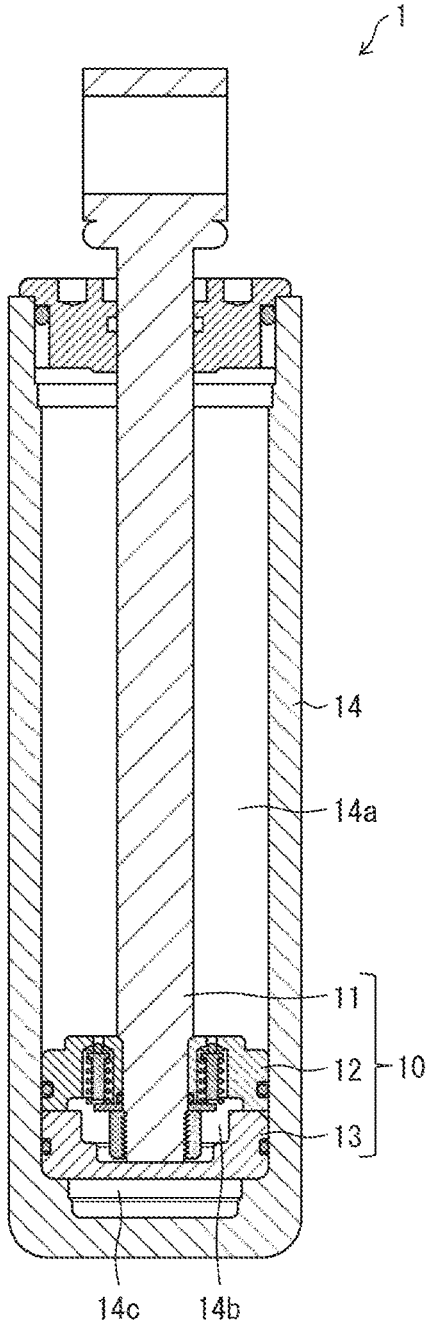
FIG. 1 is a sectional view of a cylinder device according to Embodiment 1.

FIG. 1 is a sectional view showing a configuration example of the cylinder device 1. As shown in FIG. 1, the cylinder device 1 is provided with a piston structure body 10 and a cylinder 14. The piston structure body 10 includes a piston rod 11, a piston 12, and a free piston 13. The piston 12 is fixed to an end portion (a lower end portion in FIG. 1) of the piston rod 11. The free piston 13 is disposed on one side (a lower side in FIG. 1) of the piston 12. Incidentally, the configuration of the piston structure body 10 including the free piston will be described in the present embodiment. However, this does not have to limit the present embodiment. The piston structure body may have a configuration from which the free piston is excluded.

The inside of the cylinder 14 provided in the cylinder device 1 is partitioned into a second chamber 14*b* and a first chamber 14*a* by the piston 12. The second chamber 14*b* is disposed on the side of the free piston 13. The first chamber 14*a* is disposed on an opposite side to the second chamber 14*b* with interposition of the piston 12 therebetween. A state in which the first chamber 14*a* is disposed on an upper side of the piston 12, and the second chamber 14*b* is disposed on a lower side of the piston 12 is shown in FIG. 1. In addition, the second chamber 14*b* and a third chamber 14*c* of the cylinder 14 are separated from each other by the free piston 13. A state in which the second chamber 14*b* is disposed on an upper side of the free piston 13 and the third chamber 14*c* is disposed on a lower side of the free piston 13 is shown in FIG. 1. Incidentally, the piston structure body is not limited to the configuration including the free piston 13. When the piston structure body has the configuration from which the free piston is excluded, the second chamber 14*b* and the third chamber 14*c* are not distinguished from each other. For this reason, in the configuration from which the free piston is excluded, the third chamber 14*c* may be also referred to as second chamber.

Incidentally, the first chamber 14*a* of the cylinder 14 may be also referred to as upper chamber, and the third chamber 14*c* of the cylinder 14 may be also referred to as lower chamber.

The cylinder device 1 is a device which controls supply or discharge of hydraulic oil to or from the first chamber 14*a* and the third chamber 14*c* of the cylinder 14 to thereby control driving of the piston rod 11. Incidentally, a third chamber oil channel not shown is connected to the third chamber 14*c*. Due to the hydraulic oil supplied to the third chamber 14*c* through the third chamber oil channel, the piston 12 and the free piston 13 ascends so that the piston rod 11 fixed to the piston 12 ascends accordingly.

Figure 2:
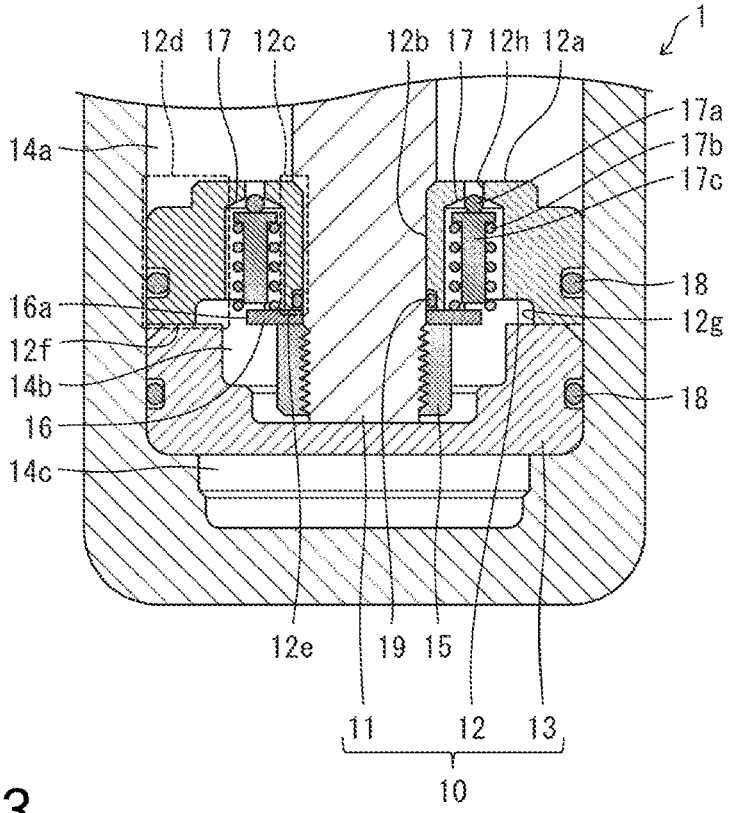
FIG. 2 is an enlarged sectional view of a piston structure body according to Embodiment 1.

Successively, the configuration example of the piston structure body 10 will be described more specifically with reference to FIG. 2. FIG. 2 is an enlarged sectional view showing the configuration example of the piston structure body 10.

(Piston 12)

The piston 12 is provided with a through hole 12*b*, an inner circumferential portion 12*c*, and an outer circumferential portion 12*d*. The through hole 12*b* is formed to penetrate the piston 12 axially through the center of a first face 12*a*. The first face 12*a* is provided on one end side in an axial direction (an up/down direction of a sheet of FIG. 2) of the piston structure body 10. The inner circumferential portion 12*c* defines the through hole 12*b*, and is connected to the first face 12*a*. The outer circumferential portion 12*d* is disposed to surround the inner circumferential portion 12*c*, and connected to the first face 12*a*. The piston rod 11 is inserted through the through hole 12*b* provided in the piston 12.

In addition, the piston 12 is provided with a protective valve 17 and a return valve (not shown). When oil pressure in the first chamber 14*a* increases to be higher than predetermined pressure, the protective valve 17 sends out hydraulic oil in the first chamber 14*a* to the second chamber 14*b*. The return valve sends out the hydraulic oil from the second chamber 14*b* to the first chamber 14*a*. Incidentally, when the piston structure body has the configuration from which the free piston is excluded, the piston 12 is not provided with the return valve. A hydraulic oil sending-out method of the protective valve 17 will be described later.

A recess is formed in the outer circumferential portion 12*d* of the piston 12 to extend along the outer circumference of the piston 12. An O-ring 18 is fitted into the recess. In addition, a recess is formed in an end face of the inner circumferential portion 12*c* of the piston 12 on a back face side (the other end side in the axial direction of the piston structure body 10) of the first face 12*a* to extend along an inner circumference of the through hole 12*b* of the piston 12. An O-ring 19 is fitted into the recess.

In addition, the piston 12 is fixed to the piston rod 11 by use of an annular member 16 and a fixation member 15. The annular member 16 is inserted and fitted to a second chamber 14*b* side end portion of the piston rod 11 inserted through the through hole 12*b*. The fixation member 15 is screwed to the second chamber 14*b* side end portion of the piston rod 11. Here, for example, a washer etc. can be used as the annular member 16. For example, a nut etc. can be used as the fixation member 15.

In addition, the piston 12 has a first end face 12*e* and a second end face 12*f*. The first end face 12*e* is an end face of the inner circumferential portion 12*c* on the back face side of the first face 12*a*. The second end face 12*f* is an end face of the outer circumferential portion 12*d* on the back face side. As shown in FIG. 2, the piston 12 is provided with the first end face 12*e* and the second end face 12*f* so that the first end face 12*e* is positioned more closely to the first end surface 12*a* than the second end face 12*f* in the axial direction of the piston structure body 10. Thus, at least a portion of the annular member 16 can be disposed at a position offset more toward the first face 12*a* than the second end face 12*f*. In addition, the fixation member 15 can be disposed at a position offset more toward the first face 12*a* than that in a background-art piston structure body in which a first end face 12*e* is not positioned more closely to a first face 12*a* than a second end face 12*f*. Thus, since an axial length of the free piston 13 can be shortened, a stroke length of the piston rod 11 can be increased more greatly than that in the background-art piston structure body.

Here, the annular member 16 inserted and fitted to the end portion of the piston rod 11 on the aforementioned back face side so as to abut against the first end face 12*e* of the inner circumferential portion 12*c* is fixed to the piston rod 11, as shown in FIG. 2. In addition, for example, the piston 12 has a recess 12*g* which is concaved from the second end face 12*f* of the outer circumferential portion 12*d* so as to be opposed to an outer edge 16*a* of the annular member 16. With this configuration, sending out hydraulic oil is not blocked by the annular member 16 but the hydraulic oil can be sent out more smoothly from the first chamber 14*a* of the cylinder 14 toward the second chamber 14*b* thereof through the protective valve 17.

To be more specific, the first end face 12*e* of the inner circumferential portion 12*c* of the piston 12 is preferably provided so that the whole of the annular member 16 can be arranged and disposed more closely to the first face 12*a* than the second end face 12*f* surrounding the recess 12*g*. That is, when a thickness of the annular member 16 in an axial direction (an up/down direction of a sheet of FIG. 1) of the piston rod 11 is designated by h1 (see FIG. 4A about h1), the first end face 12*e* arranged and disposed more closely to the first face 12*a* than the second end face 12*f* is preferably provided so that a distance between the first end face 12*e* and the second end face 12*f* in the axial direction of the piston rod 11 is not shorter than h1. Thus, it is possible to further offset the position of the fixation member 15 toward the first face 12*a*. In accordance with this, the axial length of the free piston 13 can be further shortened. Accordingly, it is possible to further increase the stroke length of the piston rod 11.

(Free Piston 13)

As shown in FIG. 2, the free piston 13 is a piston not fixed to the piston rod 11. The free piston 13 has a recess which can receive the end portion of the piston rod 11 on the aforementioned back face side and the fixation member 15 protruding toward the free piston 13 from the second end face 12*f* of the piston 12. Thus, the second end face 12*f* of the piston 12 and an end face of the free piston 13 on the piston 12 side can be made abut against each other without being blocked by the end portion of the piston rod 11 on the aforementioned back face side and the fixation member 15.

In addition, by the free piston 13, the internal space of the cylinder 14 disposed on the back face side of the first face 12*a* in the piston 12 is partitioned into the second chamber 14*b* and the third chamber 14*c*. Even with the configuration in which the piston 12 is provided with the return valve, hydraulic oil in the third chamber 14*c* of the cylinder 14 can be prevented by the free piston 13 from being sent out to the first chamber 14*a* of the cylinder 14 through the return valve. The recess is formed in the free piston 13 to extend along the outer circumference of the free piston 13. The O-ring 18 is fitted into the recess.

Incidentally, in the present embodiment, the end face of the free piston 13 facing the third face 14*c* is a flat face, as shown in FIG. 2. This does not have to limit the present embodiment. For example, when a third chamber 14*c* side inner circumferential face (an inner circumferential face on a lower side of the sheet in FIG. 2) of the cylinder 14 has a recess, the third chamber 14*c* side end face of the free piston 13 may have a protrusion corresponding to the recess. Thus, the shape of the third chamber 14*c* side end face of the cylinder 14 and the shape of the third chamber 14*c* side end face of the free piston 13 are made corresponding to each other. Thus, the stroke length of the piston rod 11 can be increased easily.

(Protective Valve 17)

The protective valve 17 is provided inside the piston 12 to be positioned more closely to the first face 12*a* of the piston 12 than the annular member 16. The protective valve 17 is provided with balls 17*a*, a spring 17*b*, and a support member 17*c*. The support member 17*c* is inserted and fitted into a hollow portion of the spring 17*b*.

The balls 17*a* are provided on an oil channel between the first chamber 14*a* and the second chamber 14*b* of the cylinder 14. Each of the balls 17*a* is larger in diameter than a through hole 12*h* formed in the first face 12*a* of the piston 12. The support member 17*c* has a small diameter portion, and a flange portion larger in diameter than the small diameter portion. The small diameter portion of the support member 17*c* is inserted and fitted into the spring 17*b*. The flange portion of the support member 17*c* is urged toward the first chamber 14*a* by the spring 17*b* so that the balls 17*a* are pressed by a first chamber 14*a* side end face of the flange portion so as to close the through hole 12*h*.

Figure 3:
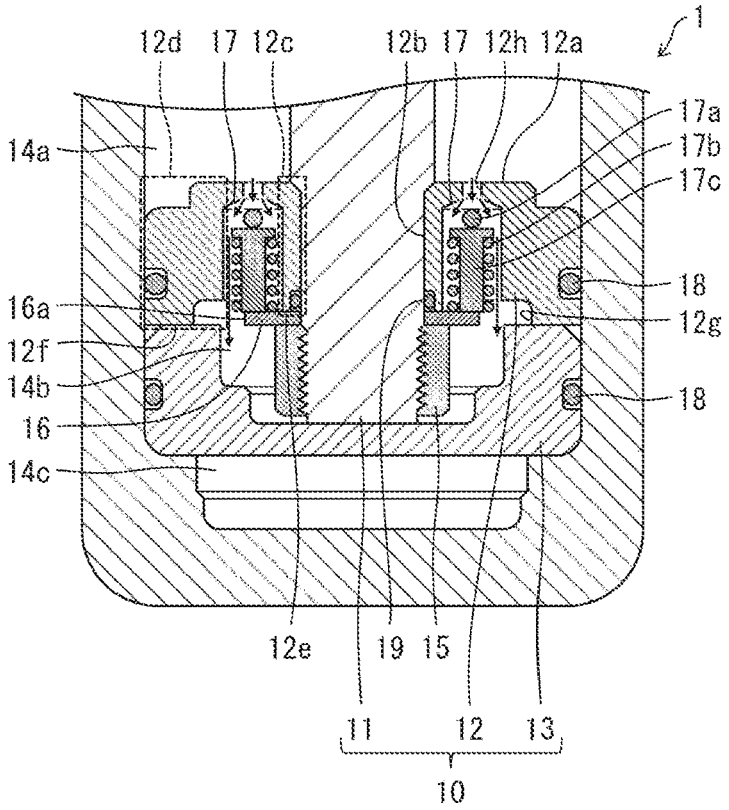
FIG. 3 is an enlarged sectional view of the piston structure body according to Embodiment 1.

Operation of the protective valve 17 will be described more specifically with reference to FIG. 3 as follows.

In the cylinder device 1, when the piston 12 is pulled toward the first chamber 14*a* of the cylinder 14 together with the piston rod 11 due to some external force, oil pressure in the first chamber 14*a* increases. When force of hydraulic oil in the first chamber 14*a* pressing the balls 17*a* exceeds force urged by the spring 17*b*, the balls 17*a* are pressed toward the second chamber 14*b* by the hydraulic oil in the first chamber 14*a* to thereby open the protective valve 17. Thus, the hydraulic oil is sent out from the first chamber 14*a* toward the second chamber 14*b*, as designated by arrows in FIG. 3.

Thus, only when oil pressure in the first chamber 14*a* increases to be higher than predetermined pressure, the protective valve 17 sends out the hydraulic oil in the first chamber 14*a* to the second chamber 14*b*. Otherwise, the protective valve 17 blocks circulation of the hydraulic oil between the first chamber 14*a* and the second chamber 14*b* of the cylinder 14.

Here, as described above, the recess 12*g* which sinks so as to be opposed to the outer edge 16*a* of the annular member 16 is provided in the outer circumferential portion 12*d* of the piston 12 according to the present embodiment. With this configuration, sending out hydraulic oil is not blocked by the annular member 16 but the hydraulic oil can be sent out smoothly toward the second chamber 14*b* through the recess 12*g*.

Incidentally, in the piston 12 according to the present embodiment, the annular member 16 is offset more toward the first face 12*a* than the second end face 12*f*. Therefore, it is preferable to use the spring 17*b* whose equilibrium length is shorter than that when the annular member 16 is not offset. When the spring 17*b* whose equilibrium length is shorter is used thus, it is preferable to use a configuration in which, for example, a spring with a larger spring constant is used or the diameter of the through hole 12*h* is made smaller, than that when the annular member 16 is not offset. In this manner, even when the spring 17*b* whose equilibrium length is shorter than that when the annular member 16 is not offset is used, oil pressure for opening the protective valve 17 can be kept high in a manner similar to or the same as when the annular member 16 is not offset. Incidentally, when the configuration in which the diameter of the through hole 12*h* is made smaller is used, the number of protective valves 17 in the piston 12 in the configuration may be increased to be more than that when the annular member 16 is not offset, so that the quantity of hydraulic oil to be sent out from the first chamber 14*a* toward the second chamber 14*b* can be prevented from being reduced.

(Comparison with Comparative Example)

Figure 4A:
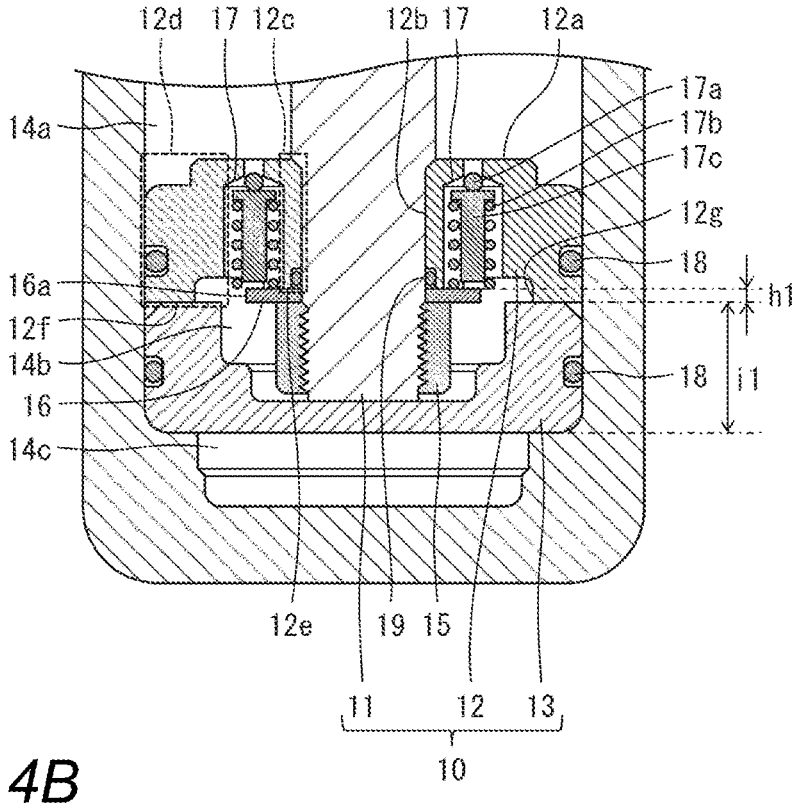
FIG. 4A is an enlarged sectional view of the piston structure body according to Embodiment 1.
Figure 4B:
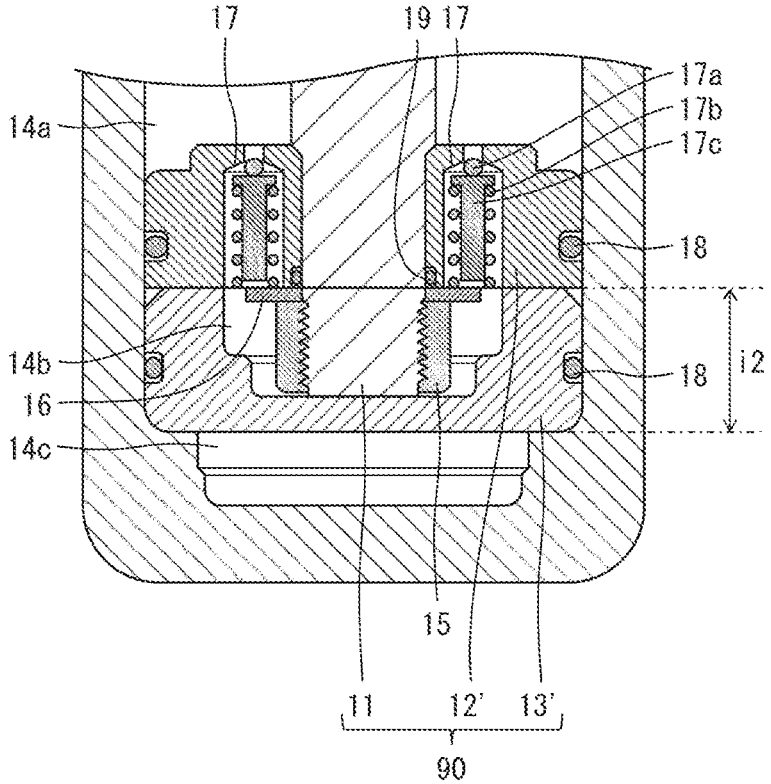
FIG. 4B is an enlarged sectional view of a piston structure body according to a comparative example.

Successively, the piston structure body 10 according to the present embodiment and a piston structure body 90 according to a comparative example will be compared with each other with reference to FIGS. 4A and 4B. FIG. 4A shows an enlarged sectional view of a configuration example of the piston structure body 10. FIG. 4B is an enlarged sectional view of a configuration example of the piston structure body 90.

In the piston structure body 10 according to the present embodiment, the annular member 16 is positioned more closely to the first face 12*a* than the second end face 12*f*, as shown in FIG. 4A. On the other hand, in the position structure body 90 according to the comparative example, an annular member 16 is disposed at a position protruding toward a free piston 13' from a free piston 13' side end face of a piston 12', i.e. positioned more closely to a second chamber 14*b* than a back face side end portion of the piston 12', as shown in FIG. 4B.

In the piston structure body 10, the annular member 16 is positioned more closely to the first face 12*a* than the second end face 12*f*. Accordingly, the position of the fixation member 15 can be offset more toward the first chamber 14*a* by an axial length h1 of the annular member 16. In the piston structure body 10, an axial length i1 of the free piston 13 can be shortened by the offset length h1. Thus, the axial length i1 of the free piston 13 according to the present embodiment is shorter than an axial length i2 of the free piston 13' provided in the piston structure body 90 according to the comparative example. In this manner, the stroke length of the piston rod 11 can be increased according to the piston structure body 10.

Embodiment 2

A cylinder device 1*a* according to Embodiment 2 will be described with reference to FIG. 5.

Figure 5:
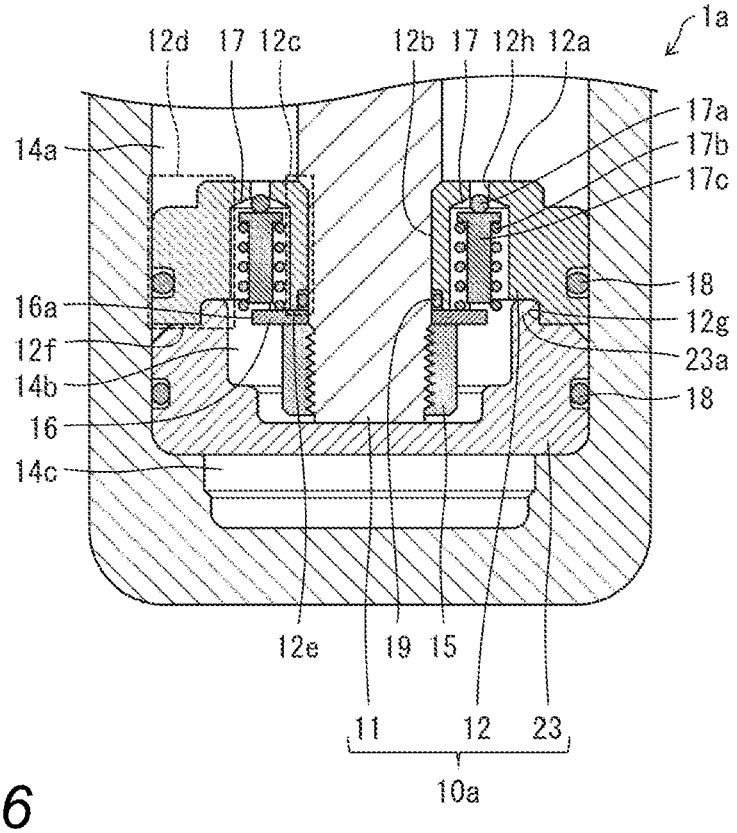
FIG. 5 is an enlarged sectional view of a cylinder structure body according to Embodiment 2.

FIG. 5 is an enlarged sectional view showing a configuration example of a piston structure body 10*a* (a piston structure body 10*a* according to Embodiment 2) in the cylinder device 1*a*. The piston structure body 10*a* is configured in a manner similar to or the same as the piston structure body 10 except that the piston structure body 10*a* is provided with a free piston 23 replacing the free piston 13. In the following description, members which are similar to or the same as the aforementioned members will be referred to by the same signs correspondingly and respectively, and description thereof will be omitted.

As shown in FIG. 5, the free piston 23 is a piston which is not fixed to a piston rod 11. The free piston 23 has a recess which can receive an end portion of the piston rod 11 and a fixation member 15 protruding toward a back face side of a first face 12*a* from a second end face 12*f* of a piston 12, in a manner similar to or the same as the free piston 13. In addition, the free piston 23 has a protrusion 23*a* in an end portion of the free piston 23 on the piston 12 side. The protrusion 23*a* is fitted to a recess 12*g* which sinks so as to be opposed to an outer edge 16*a* of an annular member 16. Due to the recess 12*g* of the piston 12 and the protrusion 23*a* of the free piston 23 which are fitted to each other, the free piston 23 can be suppressed from leaning inside a cylinder 14.

Incidentally, an end face of the free piston 23 facing a third chamber 14*c* is a flat face in the present embodiment, as shown in FIG. 5. However, this does not have to limit the present embodiment. When, for example, a third chamber 14*c* side inner circumferential face of the cylinder 14 (an inner circumferential face on a lower side of a sheet in FIG. 5) has a recess, the third chamber 14*c* side end face of the free piston 23 has a protrusion corresponding to the recess. In this manner, the shape of the third chamber 14*c* side end face of the cylinder 14 and the shape of the third chamber 14*c* side end face of the free piston 23 are made corresponding to each other. Accordingly, a stroke length of the piston rod 11 can be increased easily.

Embodiment 3

A cylinder device 1*b* according to Embodiment 3 will be described with reference to FIGS. 6 and 7.

Figure 6:
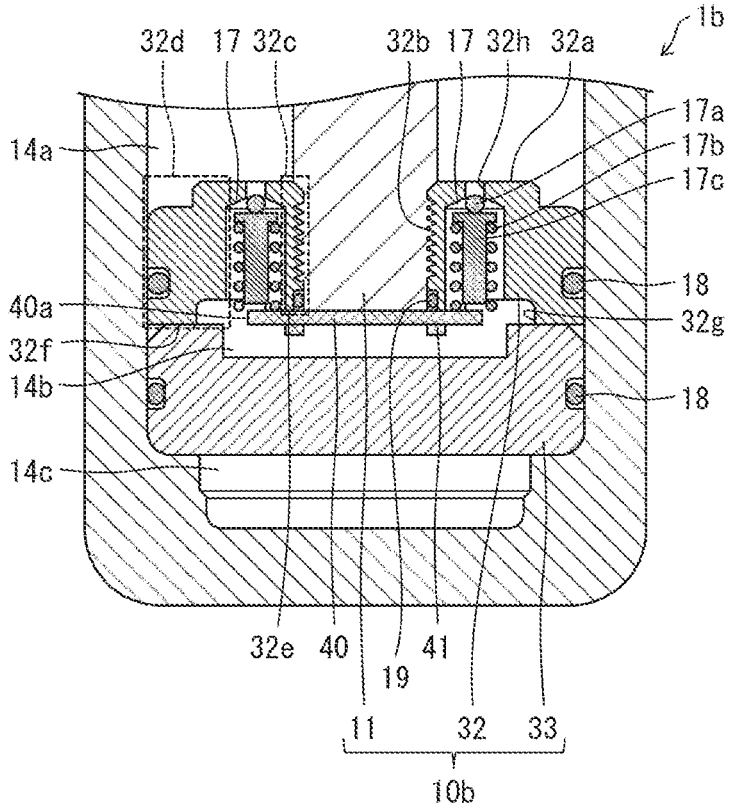
FIG. 6 is an enlarged sectional view of a cylinder structure body according to Embodiment 3.
Figure 7:
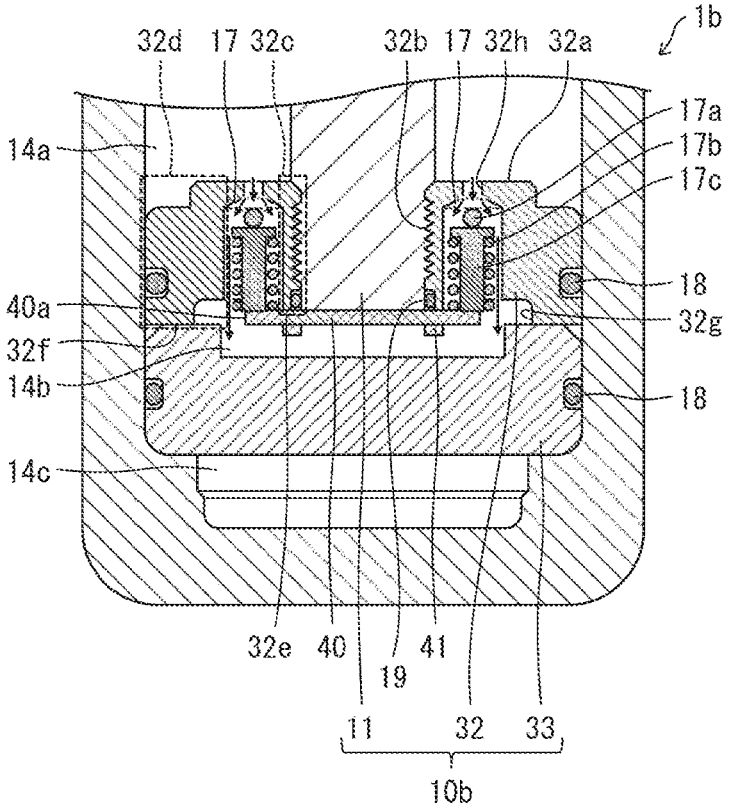
FIG. 7 is an enlarged sectional view of the cylinder structure body according to Embodiment 3.

FIG. 6 is an enlarged sectional view showing a configuration example of a piston structure body 10*b* (a piston structure body 10*b* according to Embodiment 3) in the cylinder device 1*b*. The piston structure body 10*b* has a configuration which is similar to or the same as that of the piston structure body 10 except that the piston structure body 10*b* is provided with a piston 32, a free piston 33, a plate-like member 40, and a fixation member 41 replacing the piston 12, the free piston 13, the fixation member 15 and the annular member 16. In the following description, members which are similar to or the same as the aforementioned members will be referred to by the same signs correspondingly and respectively, and description thereof will be omitted.

The piston 32 is provided with a through hole 32*b* which is formed to penetrate the piston 32 axially through the center of a first face 32*a*. The first face 32*a* is provided on one end side in an axial direction (an up/down direction of a sheet of each of FIG. 6 and FIG. 7) of the piston structure body 10*b*. Screw threads are formed in an inner circumferential face of the through hole 32*b* through which a piston rod 11 is inserted. In addition, screw threads are formed in an end portion of the piston rod 11 on a back face side of the first face 32*a* to be engaged with the screw threads formed in the inner circumferential face of the through hole 32*b*. Through these screw threads, the piston 32 and the rod piston 11 are screwed to each other.

The plate-like member 40 is arranged and disposed to abut against a first end face 32*e* of an inner circumferential portion 32*c* of the piston 32. In addition, the fixation member 41 fixes the plate-like member 40 in a state in which the plate-like member 40 and the first end face 32*e* of the piston 32 are in contact with each other. Here, for example, bolts etc. can be used as the fixation member 41. Thus, at least a portion of the plate-like member 40 can be disposed at a position offset more toward the first face 32*a* than a second end face 32*f*. The second end face 32*f* is an end face of an outer circumferential portion 32*d* of the piston 32 on the back face side of the first end face 32*e*. Thus, an axial length of the free piston 33 can be reduced so that a stroke length of the piston rod 11 can be increased.

In addition, for example, the piston 32 has a recess 32*g* which is concaved from a second end face 32*f* of the outer circumferential portion 32*d* so as to be opposed to an outer edge 40*a* of the plate-like member 40. Thus, sending out hydraulic oil is not blocked by the plate-like member 40 but the hydraulic oil can be sent out more smoothly from a first chamber 14*a* of a cylinder 14 toward a second chamber 14*b* thereof through a protective valve 17.

To be more specific, the first end face 32*e* in the inner circumferential portion 32*c* of the piston 32 is preferably provided so that the whole of the plate-like member 40 can be arranged and disposed more closely to the first face 32*a* than the second end face 32*f* surrounding the recess 32*g*. That is, the first end face 32*e* arranged and disposed more closely to the first face 32*a* than the second end face 32*f* is preferably provided so that a distance between the first end face 32*e* and the second end face 32*f* in an axial direction of the piston rod 11 is not shorter than a thickness of the plat-like member 40 in the axial direction of the piston rod 11. Thus, the position of the plate-like member 40 can be further offset toward the first face 32*a*. In accordance with this, the axial length of the free piston 33 can be further shortened. Accordingly, the stroke length of the piston rod 11 can be further increased.

As shown in FIG. 6, the free piston 33 is a piston which is not fixed to the piston rod 11. The free piston 33 has a recess which can receive the plate-like member 40 and the fixation member 41 protruding toward the free piston 33 from the second end face 32*f* of the piston 32. Thus, the second end face 32*f* of the piston 32 and the end face of the free piston 33 on the piston 32 side can be made abut against each other without being blocked by the plate-like member 40 and the fixation member 41.

Incidentally, in the present embodiment, the end face of the free piston 33 facing a third chamber 14*c* is a flat face, as shown in FIG. 6. However, this does not have to limit the present embodiment. When, for example, a third chamber 14*c* side inner circumferential face (an inner circumferential face on a lower side of a sheet in each of FIG. 6 and FIG. 7) of the cylinder 14 has a recess, the third chamber 14*c* side end face of the free piston 33 may have a protrusion corresponding to the recess. In this manner, the shape of the third chamber 14*c* side end surface of the cylinder 14 and the shape of the third chamber 14*c* side end face of the free piston 33 are made corresponding to each other. Accordingly, the stroke length of the piston rod 11 can be increased easily.

In addition, the protective valve 17 in the piston structure body according to the present embodiment is provided with balls 17*a*, a spring 17*b*, and a support member 17*c* which is inserted and fitted into a hollow portion of the spring 17*b*, in a manner similar to or the same as that in Embodiment 1. When force of hydraulic oil in the first chamber 14*a* of the cylinder 14 pushing the balls 17*a* exceeds force urged by the spring 17*b*, the protective valve 17 is opened. Thus, the hydraulic oil is sent out from the first chamber 14*a* of the cylinder 14 toward the second chamber 14*b* thereof through a through hole 32*h*, as designated by arrows in FIG. 7.

Thus, only when oil pressure in the first chamber 14*a* increases to be higher than predetermined pressure, the protective valve 17 sends out hydraulic oil in the first chamber 14*a* to the second chamber 14*b*. Otherwise, the protective valve 17 blocks circulation of the hydraulic oil between the first chamber 14*a* and the second chamber 14*b* of the cylinder 14.

Here, the piston 32 according to the present embodiment has the recess 32*g* which sinks so as to be opposed to the outer edge 40*a* of the plate-like member 40, as described above. With this configuration, sending out hydraulic oil is not blocked by the plate-like member 40 but the hydraulic oil can be sent out smoothly to the second chamber 14*b* through the recess 32*g*.

Embodiment 4

A lifting device 100 of a watercraft propulsion apparatus according to Embodiment 4 of the present invention (which will be hereinafter referred to as "outboard motor lifting device 100") will be described with reference to FIGS. 8A and 8B and FIGS. 9 and 10. The outboard motor lifting device 100 according to Embodiment 4 of the present invention is a lifting device of a watercraft propulsion apparatus to which the cylinder device 1 according to the aforementioned embodiment is applied as a tilt cylinder. Incidentally, a configuration to which the cylinder device 1 according to the aforementioned embodiment is applied as the tilt cylinder will be illustrated in the present embodiment. However, the outboard motor lifting device 100 according to the present embodiment may have a configuration to which the cylinder device 1 according to the aforementioned embodiment is applied as a trim cylinder provided in a lifting device of a watercraft propulsion apparatus. In addition, the present embodiment may have a configuration to which the cylinder device 1*a* or the cylinder device 1*b* according to the aforementioned embodiment is applied as a tilt cylinder provided in a lifting device of a watercraft propulsion apparatus, or a configuration to which the cylinder device 1*a* or the cylinder device 1*b* is applied as a trim cylinder provided in a lifting device of a watercraft propulsion apparatus.

Figure 8A:
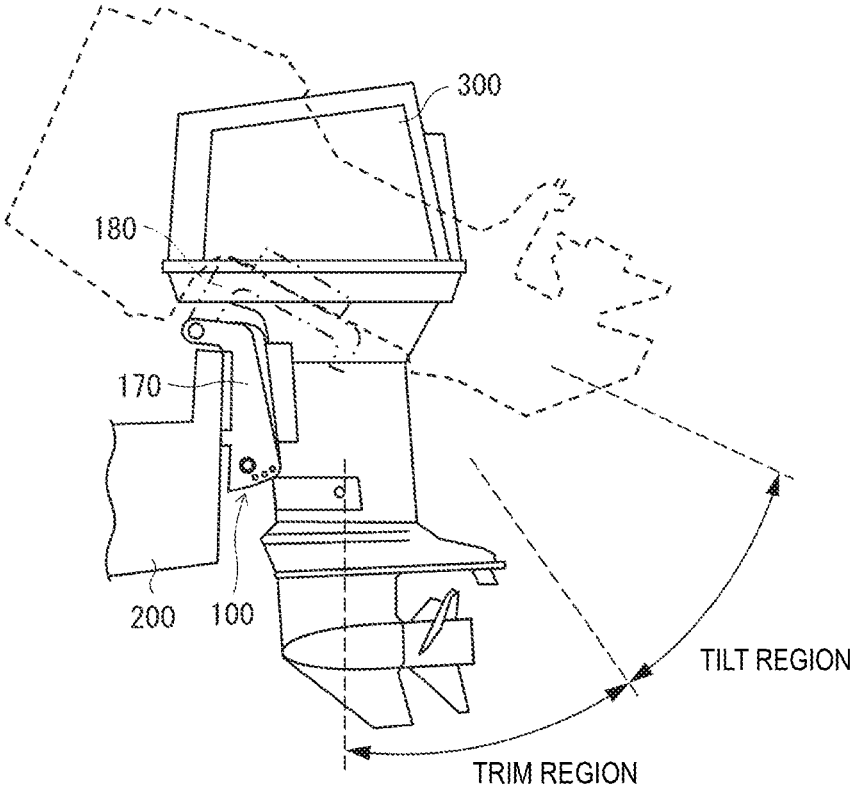
FIG. 8A is a view showing a use example of a lifting device of a watercraft propulsion apparatus according to Embodiment 4.
Figure 8B:
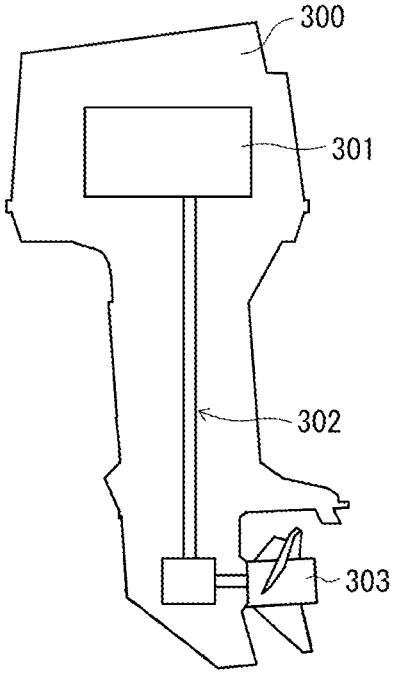
FIG. 8B is a view showing a schematic internal configuration of an outboard motor according to Embodiment 4.

The outboard motor lifting device 100 is a device for lifting an outboard motor 300 up/down. FIG. 8A is a view showing a use example of the outboard motor lifting device 100. The outboard motor lifting device 100 shown in FIG. 8A is attached to a rear portion of a hull (body) 200 and the outboard motor 300. A solid line in FIG. 8A designates a state in which the outboard motor 300 has descended. A broken line in FIG. 8A designates a state in which the outboard motor 300 has ascended. FIG. 8B is an outline view schematically showing an internal configuration of the outboard motor 300. As shown in FIG. 8B, the outboard motor 300 is provided with an engine 301, a propeller 303, and a power transmission mechanism 302 which transmits motive power from the engine 301 to the propeller 303. Here, the power transmission mechanism 302 is, for example, constituted by a shaft or a gear.

Figure 9:
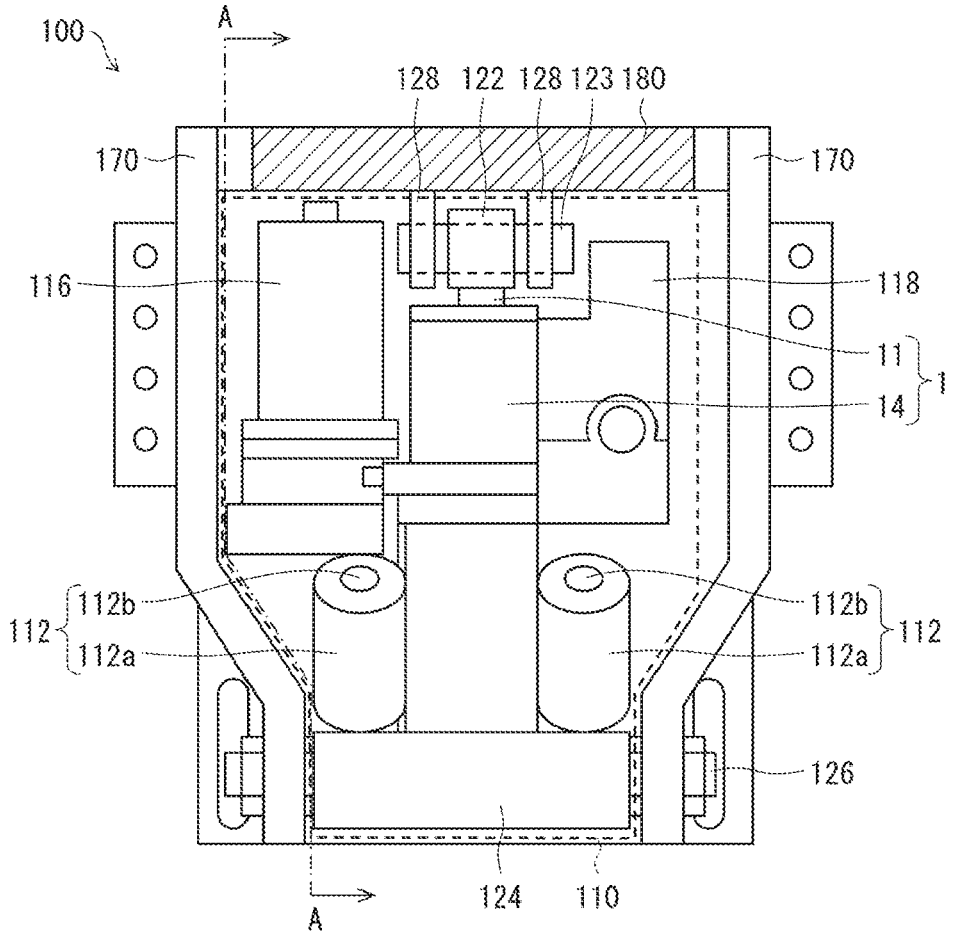
FIG. 9 is a front view showing an example of the configuration of the lifting device of the watercraft propulsion apparatus according to Embodiment 4.
Figure 10:
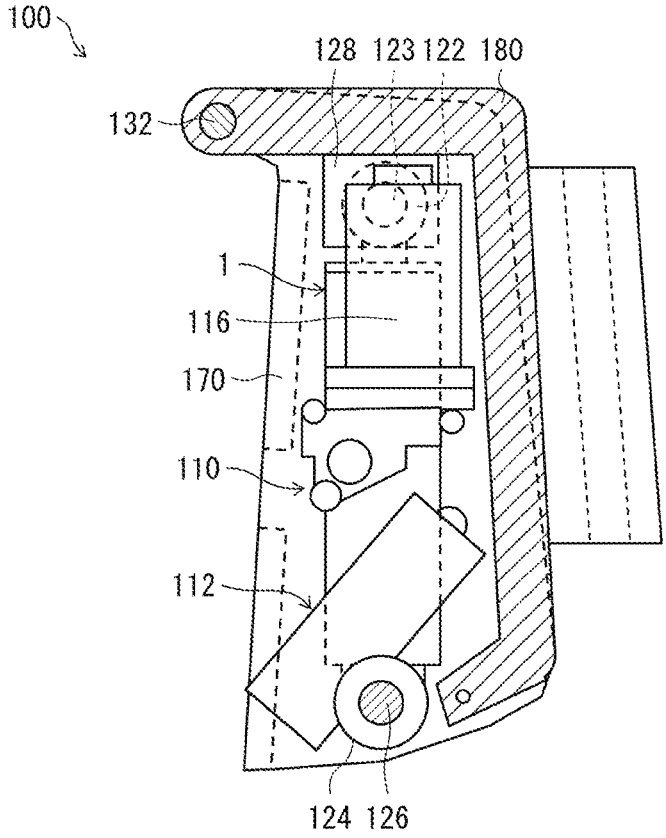
FIG. 10 is a sectional side view of the lifting device of the watercraft propulsion apparatus according to Embodiment 4.

FIG. 9 is a front view showing an example of the configuration of the outboard motor lifting device 100. FIG. 10 is a sectional view taken along an arrow line A-A in FIG. 9. As shown in FIG. 9, the outboard motor lifting device 100 is provided with a cylinder unit 110, a pair of stern brackets 170, and a swivel bracket 180. The pair of stern brackets 170 are attached to the rear portion of the hull 200. The swivel bracket 180 is attached to the outboard motor 300.

For example, the cylinder unit 110 is provided with two trim cylinders 112, one tilt cylinder 1 (the cylinder device 1), a motor 116, a tank (oil storage tank) 118, an upper portion joint 122, and a base portion 124, as shown in FIG. 9. The trim cylinders 112 and the tilt cylinder 1 are provided relatively immovably to the base portion 124.

Incidentally, the number of trim cylinders 112 and the number of tilt cylinders 1 provided in the cylinder unit 110 do not have to limit the present embodiment. A cylinder unit 110 provided with one trim cylinder 112 or a plurality of trim cylinders 112 and one tilt cylinder 1 or a plurality of tilt cylinders 1 may be also included in the present embodiment. Thus, the following description can be also applied to the cylinder unit 110 having a desired number of trim cylinders 112 and a desired number of tilt cylinders 1.

Each of the trim cylinders 112 is provided with a cylinder 112*a*, a piston provided slidably inside the cylinder 112*a*, and a piston rod 112*b* fixed to the piston. In addition, the tilt cylinder 1 is provided with a cylinder 14, a piston 12 and a piston rod 11. The piston 12 is provided slidably inside the cylinder 14. The piston rod 11 is fixed to the piston 12.

In addition, as shown in FIG. 9, through holes are formed in the base portion 124 and the stern brackets 170 respectively, and the base portion 124 and the stern brackets 170 are connected to each other relatively rotatably through an undershaft 126 penetrating the through holes.

In addition, as shown in FIG. 9, the upper portion joint 122 is provided at a front end of the piston rod 11, and support members 128 are fixed to the swivel bracket 180. Through holes are formed in the upper portion joint 122 and the support members 128 respectively so that the upper portion joint 122 and the swivel bracket 180 are connected to each other relatively rotatably through an upper shaft 123 penetrating the through holes.

In addition, through holes are formed in one ends of upper portions of the stern brackets 170 and the swivel bracket 180 respectively. As shown in FIG. 10, the stern brackets 170 and the swivel bracket 180 are connected to each other relatively rotatably through a support shaft 132 penetrating the through holes.

(Trim Region and Tilt Region)

When the piston rod 11 of the tilt cylinder 1 ascends and descends, the swivel bracket 180 ascends and descends. Accordingly, the outboard motor 300 ascends and descends.

An angle region of the outboard motor 300 adjusted by the ascent and descent of the piston rod 11 of the tilt cylinder 1 is constituted by a trim region and a tilt region shown in FIG. 8A. The tilt region is an angle region where front ends of the piston rods 112*b* of the trim cylinders 112 cannot abut against the swivel bracket 180. An angle of the outboard motor 300 in the tilt region is adjusted by the piston rod 11 of the tilt cylinder 1.

On the other hand, the trim region is an angle region where the front ends of the piston rods 112*b* of the trim cylinders 112 can abut against the swivel bracket 180. An angle of the outboard motor 300 in the trim region can be adjusted by both the piston rods 112*b* of the trim cylinders 112 and the piston rod 11 of the tilt cylinder 1.

The present invention is not limited to the aforementioned embodiments. The present invention may be changed variously in the scope of CLAIMS so that any embodiment obtained by suitably combining technical units disclosed in different embodiments respectively can be also included in the technical scope of the present invention.

The invention claimed is:

1. A piston structure body comprising:

a piston that includes a through hole, an inner circumferential portion, and an outer circumferential portion, the through hole being a hole that is formed to penetrate the piston axially through a center of a first surface that is provided on one end side in an axial direction, the inner circumferential portion defining the through hole and connected to the first surface, the outer circumferential portion disposed to surround the inner circumferential portion and connected to the first surface;

a piston rod that is inserted through the through hole;

an annular member inserted and fitted to an end portion of the piston rod on the back face side so as to abut against the first end face, said annular member being fixed to the piston rod; and a free piston that is not fixed to the piston rod on the back face side of the piston, wherein a first end face that is an end face of the inner circumferential portion on a back face side of the first surface is positioned more closely to the first surface than a second end face that is an end face of the outer circumferential portion on the back face side, the outer circumferential portion has a recess that is concaved from the second end face to be opposed to an outer edge of the annular member on the back face side, and the free piston has a protrusion fitted to the recess.

2. The piston structure body according to claim 1, wherein the annular member is arranged more closely to the first surface than the second end face surrounding the recess.

3. A lifting device of a watercraft propulsion apparatus, comprising:

the piston structure body according to claim 1.

4. A piston structure body comprising:

a piston that includes a through hole, an inner circumferential portion, and an outer circumferential portion, the through hole being a hole that is formed to penetrate the piston axially through a center of a first surface that is provided on one end side in an axial direction, the inner circumferential portion defining the through hole and connected to the first surface, the outer circumferential portion disposed to surround the inner circumferential portion and connected to the first surface;

a piston rod that is inserted through the through hole;

a plate-like member that is arranged so as to abut against the first end face;

a fixation member that fixes the plate-like member in a state in which the plate-like member and the first end face are in contact with each other; and a free piston that is not fixed to the piston rod on the back face side of the piston, wherein the outer circumferential portion has a recess that is concaved from the second end face so as to be opposed to an outer edge of the plate-like member on the back face side, and the free piston has a protrusion fitted to the recess.

5. The piston structure body according to claim 4, wherein the plate-like member is arranged more closely to the first surface than the second end face surrounding the recess.

* * * * *